US008210279B2

(12) United States Patent
Tarique

(10) Patent No.: US 8,210,279 B2
(45) Date of Patent: Jul. 3, 2012

(54) METHODS AND SYSTEMS FOR TRIPPING PIPE

(75) Inventor: Zaurayze Tarique, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 457 days.

(21) Appl. No.: 12/326,727

(22) Filed: Dec. 2, 2008

(65) Prior Publication Data

US 2010/0135750 A1 Jun. 3, 2010

(51) Int. Cl.
*E21B 19/20* (2006.01)

(52) U.S. Cl. ..... 175/40; 414/22.51; 166/380; 175/85

(58) Field of Classification Search ..... 175/24, 175/40, 27, 85; 166/300, 380; 414/22.51; 700/213, 302

See application file for complete search history.

(56) References Cited

U.S. PATENT DOCUMENTS 4,604,724 A * 8/1986 Shaginian et al. ..... 700/213
4,748,563 A * 5/1988 Anthoine ..... 700/302

* cited by examiner

*Primary Examiner* — David Andrews
(74) *Attorney, Agent, or Firm* — Colin L. Wier

(57) ABSTRACT

Methods and systems are for tripping pipe on a rig floor that is positioned over a well. A measuring device is operated to measure a length characteristic of a first drill pipe in a plurality of separated drill pipes. The length characteristic is inputted into a controller configured to control machinery to hoist the first drill pipe above the drill string, to connect the first drill pipe to the uppermost drill pipe in the drill string, and to operate the drill string to drill into the well. The controller is operated to calculate a first vertical position into which it is necessary to hoist the first drill pipe so that a predetermined clearance distance exists between the lower end of the first drill pipe and the upper end of the uppermost drill pipe in the drill string.

29 Claims, 7 Drawing Sheets

METHODS AND SYSTEMS FOR TRIPPING PIPE

FIELD

The present application relates to the well drilling industry and particularly to methods and systems for tripping pipe on a drill rig.

BACKGROUND

Drill pipes, tubulars, and the like are often used to drill holes for oil and gas wells. A series of drill pipes are attached end to end to form an elongated drill string. A rotatable bit for making new hole is attached to the lowermost end of the string. Assembly and disassembly of the string is accomplished by a process called "tripping". To "trip in" to a hole being drilled, new pipes are sequentially added to the upper end of the string to allow the string to be run further into the hole. To "trip out" of a hole once it has been drilled, pipes are sequentially removed from the upper end of the string as it is removed from the hole.

Conventional systems for performing a tripping process include a drill rig having a floor and a rotary table positioned over a hole to be drilled in the ground. A mechanized catwalk is configured to move new drill pipes towards the rig floor. The drill pipe "in the hole" extends above the rotary table by a height called the "stick-up". A hoisting device, such as a winch or pulley system having a traveling block, is supported on a mast assembly above the rig floor. To trip a new pipe into the hole, the hoisting device is clamped to the new pipe and then moved upwards to allow the pipe to swing freely above the stick-up section of the drill pipe in the rotary table. The lower end of the pipe is then aligned with and stabbed into the upper end of the drill pipe in the rotary table. Thereafter, joystick controls are manually operated to move a torque-making machine, such as a mechanized wrench, tongs, and/or the like, to the well center and to engage with and torque the pipe to the string or the drill pipe is torqued manually using conventional tongs. Thereafter a slip mechanism holding the string in place is released and the string is run further into the hole. The above process is continued repeatedly to trip into the hole, and repeatedly in reverse order to trip out of the hole.

SUMMARY

The present application recognizes that conventional systems and methods for tripping pipe are inefficient. For example, it is currently necessary to manually control several items of machinery during the tripping process to ensure that the stick-up height of the drill string and the clearance distance between the drill string and a pipe to be tripped are both within operational parameters of the torque making machine. That is, a typical torque making machine can only engage with the drill string and the pipe to be tripped at a predetermined vertical location above the drill floor. In conventional systems, it is necessary to use manual control to achieve the correct stick-up height and clearance distance necessary to facilitate attachment of the torque-making machine. Manual control of the hoisting device is often required to achieve the correct clearance distance between the upper end of the drill string and the lower end of the pipe to be tripped. Also, manual control of the torque making machine is often required to move the torque making machine to the correct location at the well center and to cause the torque making machine to engage with and connect or disconnect the drill string and pipe to be tripped. Each of these interventions is time consuming, expensive, and can unfortunately result in operator error and/or operator injury.

The present application provides improved methods and systems for tripping pipe that overcome disadvantages of the prior art. In several of the examples, systems and methods are provided for controlling the operation of drilling machinery in such a way that complete automation of a tripping process without the need for manual intervention is possible.

In one example, a method of tripping pipe includes the steps of providing a first drill pipe having upper and lower ends (commonly known as "box" and "pin" ends); providing a second drill pipe having an upper end box extending in a vertical direction above the rig floor by a stick-up height; measuring a length characteristic of the first drill pipe; calculating, based upon the measured length characteristic of the first drill pipe and the stick-up height of the second drill pipe, a vertical position into which it is necessary to place the first drill pipe to complete a tripping process for the first and second drill pipes; and moving the first drill pipe into the vertical position.

In the above example, the calculated vertical position can be a first position wherein the lower end of the first drill pipe and the upper end of the second drill pipe are separated by a predetermined clearance distance. Alternately, the vertical position can be a second position wherein the upper end of the first drill pipe extends above the rig floor by the predetermined stick-up height.

In another example, a method of tripping pipe includes providing a first drill pipe having an upper end and a lower end, providing a second drill pipe having an upper end extending in a vertical direction above the rig floor by a stick-up height, providing a controller configured to control machinery for drilling the well, measuring a length characteristic of the first drill pipe, and inputting the length characteristic of the first drill pipe into the controller. The controller is configured to calculate, based upon the measured length characteristic of the first drill pipe and the stick-up height of the second drill pipe, a vertical position into which it is necessary to move the first drill pipe to complete a tripping process for the first and second drill pipes. Thereafter, the controller can be operated to calculate the vertical position.

In the above example, the calculated vertical position can be a first position wherein the lower end of the first drill pipe and the upper end of the second drill pipe are separated by a predetermined clearance distance. Alternately, the vertical position can be a second position wherein the upper end of the first drill pipe extends above the rig floor by the predetermined stick-up height.

The above example can further include the steps of calculating, based upon the length of the first drill pipe, a third position wherein the upper end of the second drill pipe extends above the rig floor by the predetermined stick-up height; and raising the first drill pipe into the third position so that the upper end of the second drill pipe extends above the rig floor by the predetermined stick-up height.

In another example, a system for tripping a first drill pipe and a second drill pipe having an upper end extending above the rig floor by a stick-up height includes a controller that is configured to calculate, based upon a length characteristic of the first drill pipe and the stick-up height of the second drill pipe, a vertical position in which it is necessary to move the first drill pipe to complete a tripping process for the first and second drill pipes. The controller is further configured to control the machinery to move the first drill pipe into the vertical position and to complete a tripping process for the first and second drilling pipes.

In the above example, the calculated vertical position can be a first position wherein the lower end of the first drill pipe and the upper end of the second drill pipe are separated by a predetermined clearance distance. Alternately, the vertical position can be a second position wherein the upper end of the first drill pipe extends above the rig floor by the predetermined stick-up height.

In a further example, the controller can be configured to raise the first drill pipe so that the upper end of the second drill pipe extends above the rig floor by the predetermined stick-up height.

Further examples are provided herein below.

BRIEF DESCRIPTION OF THE DRAWINGS

The best mode of carrying out the invention is described herein, with reference to the following drawing figures.

DETAILED DESCRIPTION OF THE DRAWINGS

In the following description, certain terms have been used for brevity, clearness, and understanding. No unnecessary limitations are to be implied therefrom beyond the requirement of the prior art because such terms are used for descriptive purposes only and are intended to be broadly construed. The different systems and method steps described herein may be used alone or in combination with other systems and method steps. It is to be expected that various equivalents, alternatives, and modifications are possible within the scope of the appended claims.

Figure 1:
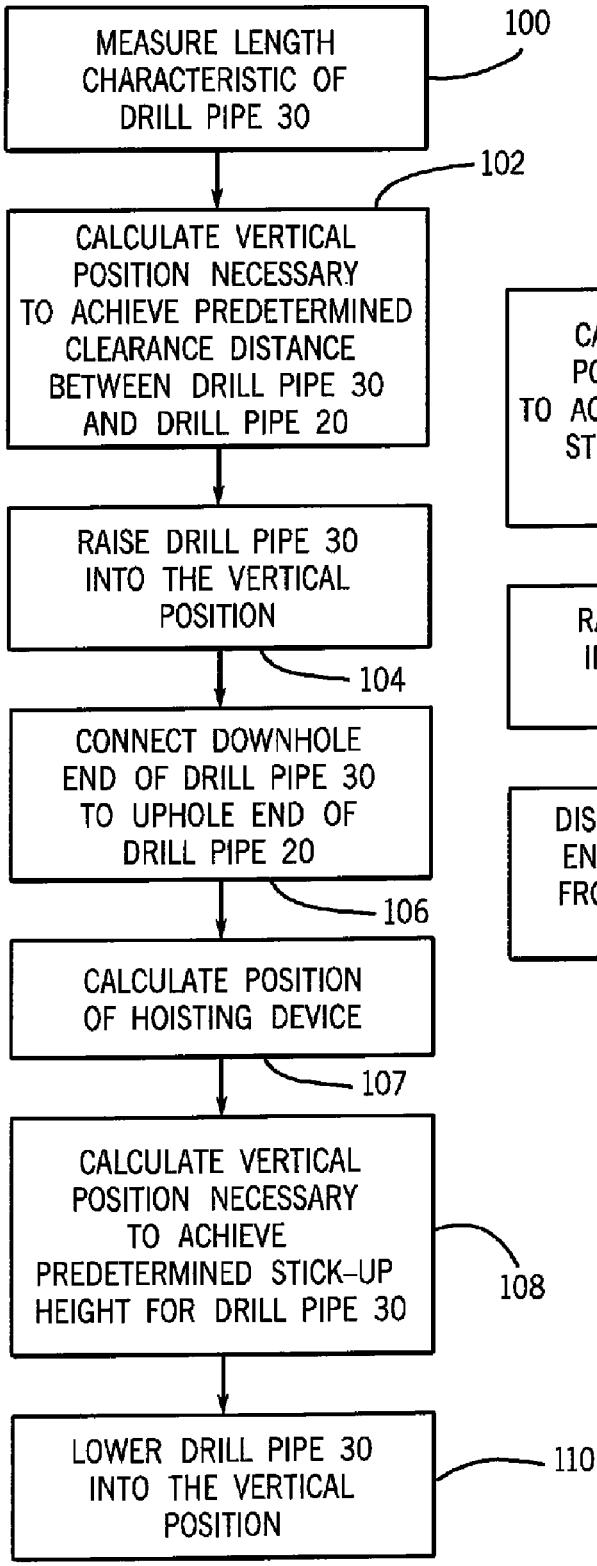
FIG. 1 is a flow chart illustrating one example of a method of tripping in hole according to the present application.
Figure 2:
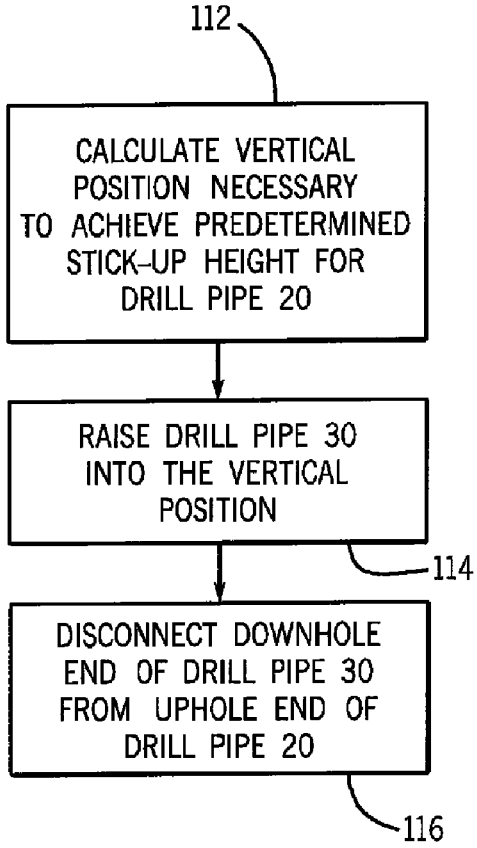
FIG. 2 is a flow chart illustrating one example of a method of tripping out of hole according to the present application.

FIGS. 1 and 2 depict exemplary method steps for completing a tripping in process according to the present application and a tripping out process according to the present application, respectively. The steps set forth in FIGS. 1 and 2 are described with reference to FIGS. 3-7 herein below.

Figure 3:
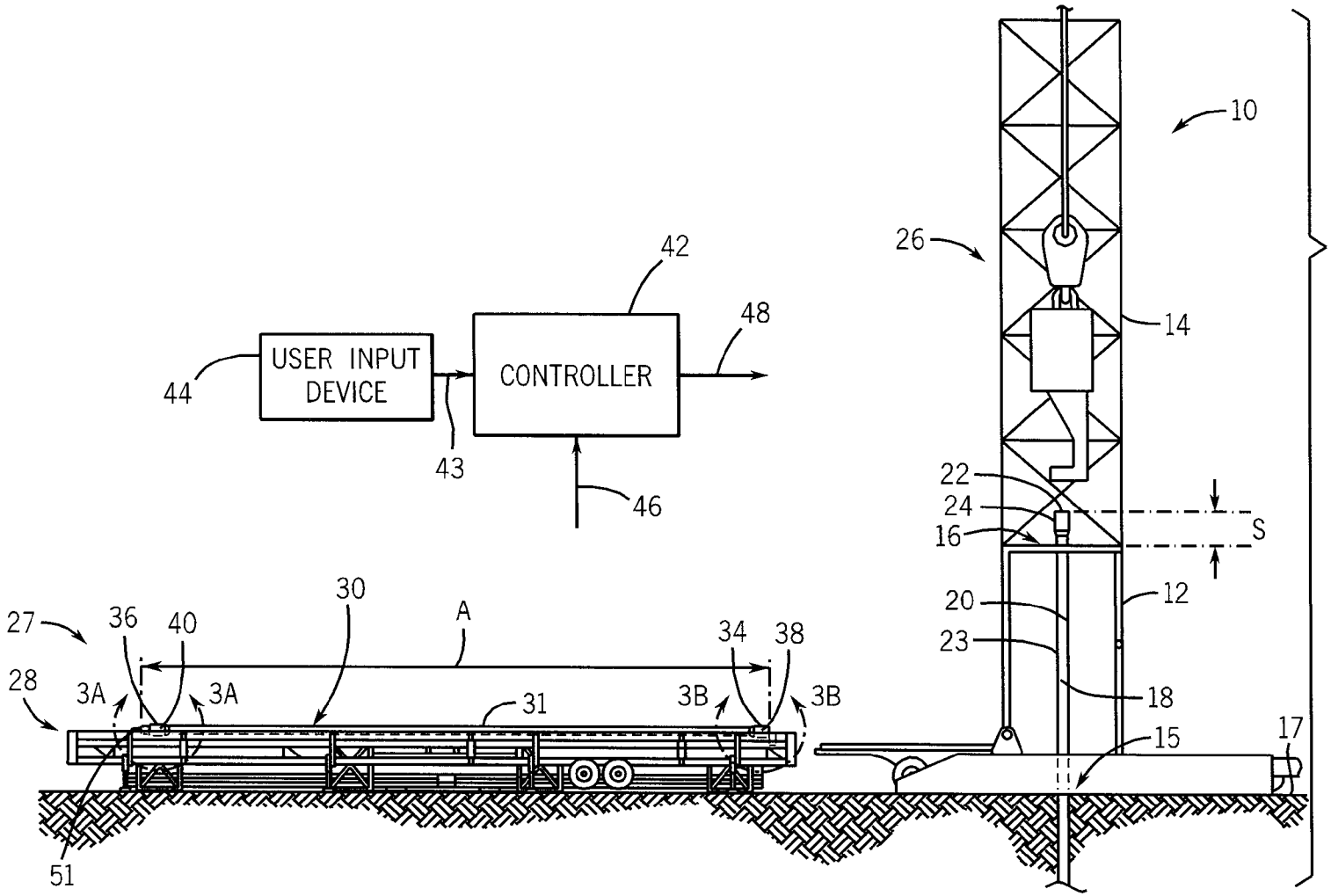
FIG. 3 is a schematic illustrating an exemplary system for tripping on a drill rig.

FIG. 3 schematically depicts an exemplary system for completing the method steps set forth in FIGS. 1 and 2. A drill rig 10 includes a conventional framed substructure 12 and a conventional framed mast structure 14. The substructure 12 defines a rig floor 16 having a rotary table (not shown) positioned over a hole 15 to be drilled in the ground 17. The mast structure 14 is positioned over the rig floor 16. A drill string 18 extends out of the hole 15 and includes an uppermost drill pipe 20 having its upper end 22 extended above the rig floor 16 by a predetermined stick-up height S. The drill pipe 20 is maintained in the position shown by conventional means such as for example a slip mechanism (not shown). The upper end 22 of the pipe 20 includes a conventional tool joint 24 (i.e. a "box"), which has a larger outer diameter than the outer diameter of the body 23 of the drill pipe 20. The tool joint 24 is configured to mate with and removably connect with a corresponding tool joint (e.g. 40; i.e. a "pin") on another drill pipe (e.g. 30), as will be described further below. A hoisting device 26 having for example a traveling block and clamp is supported on the mast structure 14 and is configured to move vertically up and down above the upper end 22 of the drill string 18. The hoisting device 26 is configured to be attached to a new drill pipe (e.g. 30), which is to be attached to the upper end 22 of the drill string 18, as will be discussed further below.

A mechanized frame or catwalk 27 is located adjacent the drill rig 10 and includes a lifting mechanism 28 for lifting drill pipes to be added to the drill string 18. In the example shown, a drill pipe 30 to be tripped is positioned in a groove 32 (FIGS. 3A and 3B) on the catwalk 27. The drill pipe 30 has a first (upper) end 34 and a second (lower) end 36, each of which have conventional tool joints 38, 40, respectively attached thereto and configured in a manner similar to that described above. Tool joint 38 has a box and tool joint 40 has a pin 51, as is conventional. A stopper mechanism 41 (FIG. 3B) which can alternately be a brake or the like is positioned in the groove 32 at one end of the lifting mechanism 28. A skate mechanism 39 (FIG. 3A), or the like, is disposed in the groove 32 at the other end of the lifting mechanism 28. A feeler gauge 44 (FIG. 3B), or like measuring instrument is positioned proximate the end 34 of the drill pipe 20 and so as to engage with the enlarged outer diameter of the tool joint 38, the enlarged outer diameter of the tool joint 40, and the smaller inner diameter of the pin 51, as will be described further below.

A controller 42 containing a memory and suitable programmable computer logic is also provided and is shown schematically in FIGS. 3, 4, 5 and 7. The controller 42 is configured to control conventional machinery associated with the drilling rig 10 for drilling the hole 15 and for completing pipe tripping processes, as described herein. The controller 42 is shown schematically as a box, however it can be configured in a variety of different ways and can include separate controller devices located apart from each other. In one example, one part of the controller 42 can be located on the rig floor 16 and be configured to control the overall drilling rig machinery. A second part of the controller 42 can be located away from the rig floor 16 and be configured to control the lifting mechanism 28, store length characteristics of the drill pipes to be tripped, and communicate the same with the first part of the controller 42. The lifting mechanism 28; a hoisting mechanism 26 such as the illustrated pulley having a clamp and traveling block; a torque-making machine such as a mechanized wrench, tongs or the like (not shown); and/or a slip mechanism (not shown) for holding the uppermost pipe (e.g. 20) in the drill string 18 in place are provided and can all be operationally controlled by one or more parts of the controller 42.

One or more user input devices 44 such as a keyboard or the like can also be included to facilitate input of user commands and associated data into the controller 42 via one or more links 43. Alternately, command inputs and data can be transmitted to the controller 42 via a wired or wireless link 46 connected to measuring equipment or other controller devices or parts of controller 42. Output from the controller 42 to the above described machinery can be transmitted for example via a wired or wireless link 48.

Figure 4:
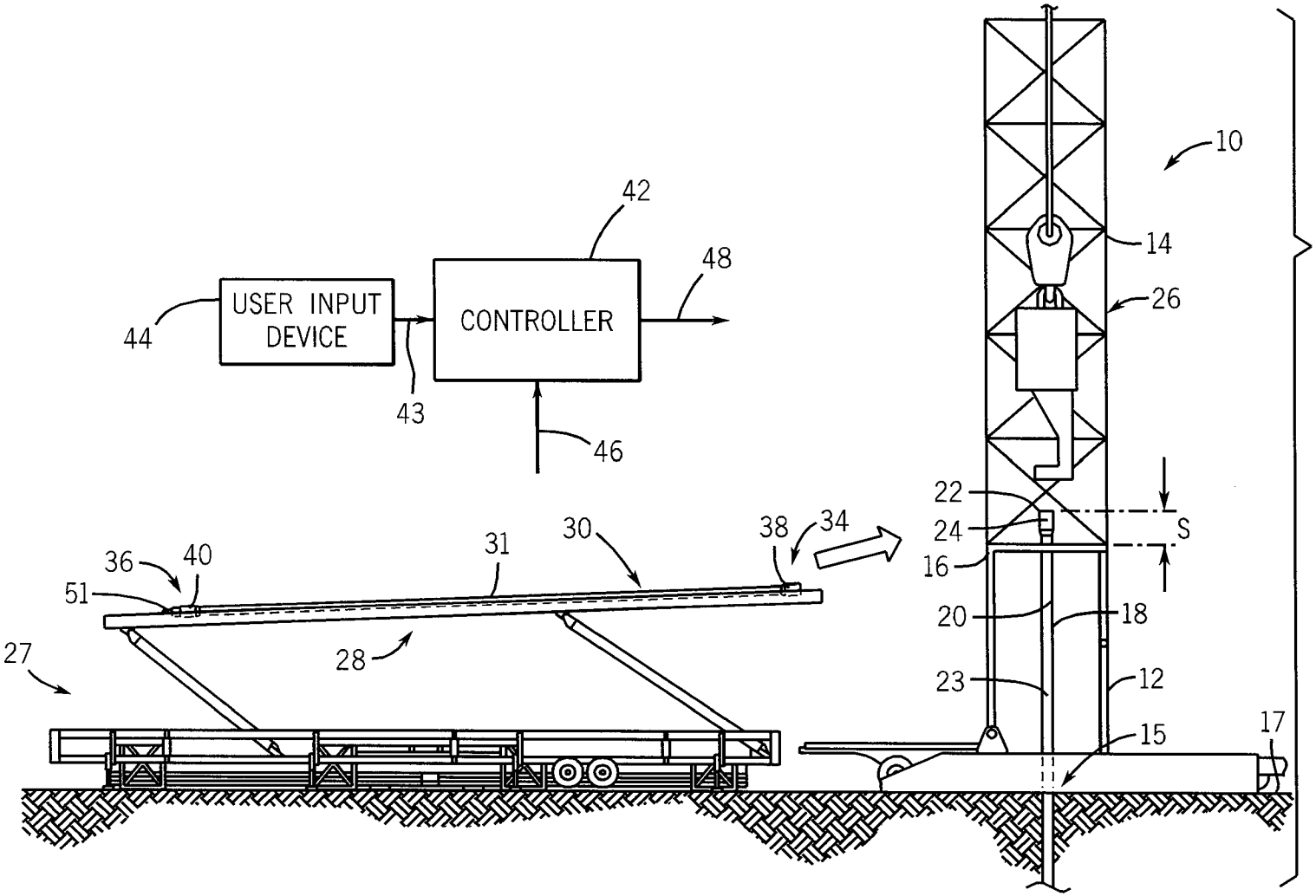
FIG. 4 is the schematic shown in FIG. 3, wherein a drill pipe to be tripped is being raised towards the drill rig.
Figure 5:
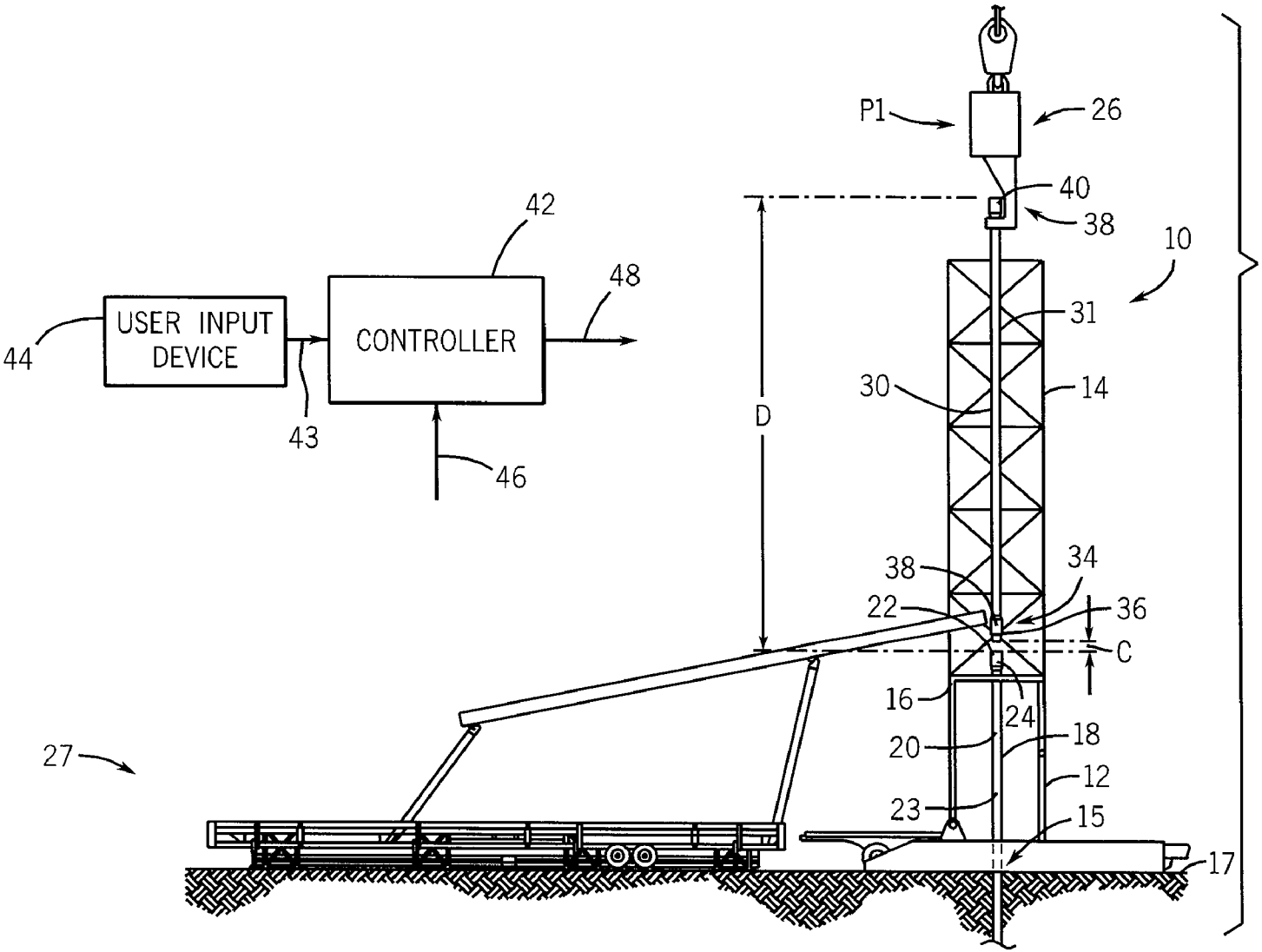
FIG. 5 is the schematic shown in FIG. 4, wherein the drill pipe is raised above a drill string by a clearance distance.

The system depicted in FIGS. 3 and 4 is capable of elevating and supporting the drill pipe 30 in a vertical, raised orientation (P1; FIG. 5) on the mast structure 14 according to conventional practices. For example, the system can include a lifting mechanism 28, which can include for example a hydraulic ramp or V-door, and a hoisting device 26 having a traveling block and a clamp that is configured to engage with and grasp the body 31 of the drill pipe 30 immediately below the tube joint 38. Once the lifting mechanism 28 is raised, the hoisting device 26 is clamped to the body of the pipe 30. Thereafter, the hoisting device 26 is raised into the vertical position shown, and the weight of the drill pipe 30 causes the enlarged outer diameter of the tool joint 38 to engage with a smaller diameter opening on the clamp, thus supporting the drill pipe 30 in a vertical orientation P1 (FIG. 5). It should be recognized however that the methods and systems described herein are also applicable with other conventional systems for elevating and supporting drill pipes in a vertical orientation. That is, the structures shown, such as the lifting mechanism 28, hoisting device 26 and drill rig 10 are shown for illustrative purposes only.

At Step 100 of the exemplary method (FIG. 1), drill pipe 30 is rolled into the groove 32 in catwalk 27. Skate mechanism 39 is operated to push the drill pipe 30 against stopper mechanism 41 in the direction of arrow 33. Once the drill pipe 30 is seated between the skate mechanism 39 and stopper mechanism 41, the distance between the skate mechanism 39 and the stopper mechanism 41 equates to a first measured length characteristic A of drill pipe 30, which in this example is the entire longitudinal length (i.e. the length from the upper end 34 to the lower end 36) of the drill pipe 30. Alternate conventional means for conducting this measurement could be used, such as for example optical, laser or motion sensors, and/or the like.

Figure 3B:
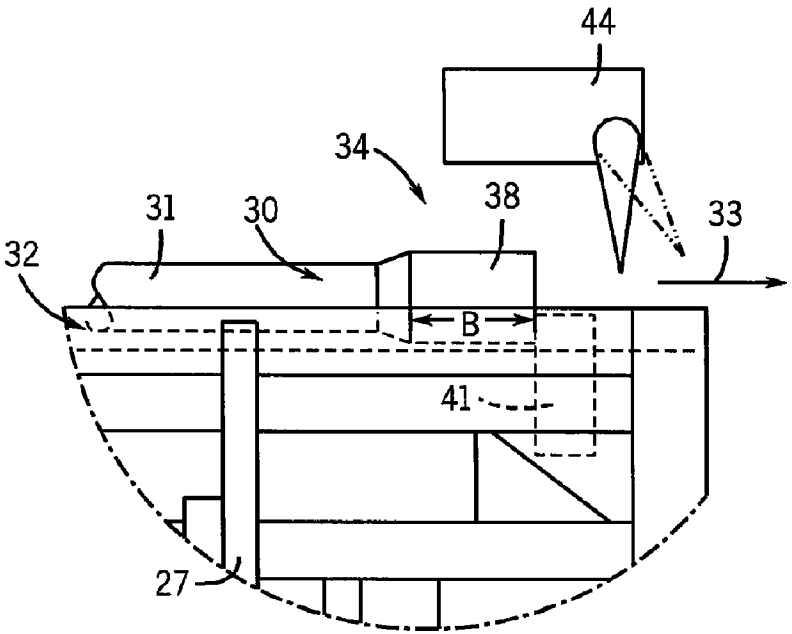
FIG. 3B is a view Section 3B-3B taken in FIG. 3.
Figure 3A:
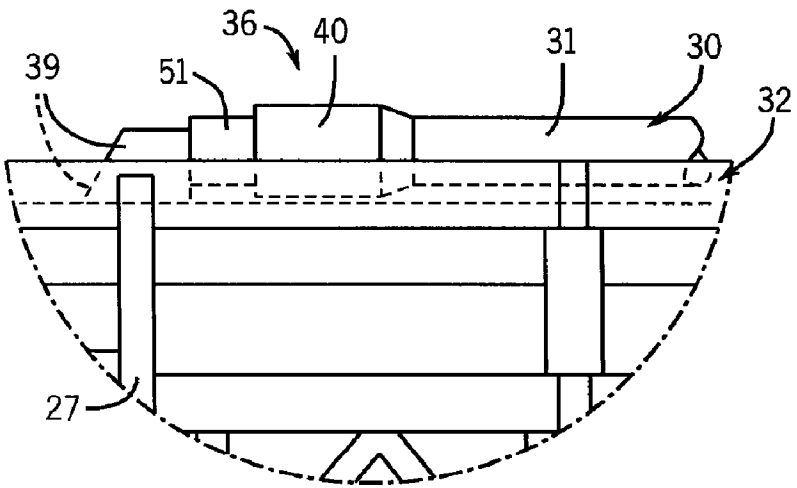
FIG. 3A is a view of Section 3A-3A taken in FIG. 3.

In the example shown, Step 100 also includes measurement of additional length characteristics of drill pipe 30, namely the length B of tool joint 38 and length P of pin 51 (FIG. 3B). Stopper mechanism 41 is removed from the groove 32 and skate mechanism 39 is operated to push drill pipe 30 longitudinally along the groove 32 towards the drill rig 10 in the direction of arrow 33. As the drill pipe 30 moves past the feeler gauge 44, the enlarged diameter of the tool joint 38 engages with and actuates the feeler gauge 44. Specifically, the feeler gauge 44 is activated upon engagement with the tool joint 38 and deactivated upon disengagement with tool joint 38 as the skate mechanism 39 pushes the drill pipe 30 past the feeler gauge 44 in the direction of arrow 33. This same process can also be employed to measure the length of the tool joint 40 and the length P of pin 51 on tool joint 40. The feeler gauge 44 is a conventional device such as a stroke counter, proximity device adapted to measure the distance between the actuations made by engagement and disengagement with the large outer diameter of the tool joint 38, which distance correlates to the entire longitudinal length B (FIG. 3B) of tool joint 38. Measurement of the length B of the tool joint 38 can be accomplished by many other alternative conventional apparatus and methods, such as optical, laser or motion sensors, and/or the like. The feeler gauge 44 or other measurement device is similarly configured to measure the length of tool joint 40 and length P of pin 51.

Once the measurements of Step 100 are completed, the measured values (e.g. A, B, P) are communicated to the controller 42 via for example the input device 44 or the link 46.

At Step 102 (FIG. 1), an elevation distance D necessary to raise the drill pipe 30 above the rig floor 16 into a position wherein a predetermined clearance distance C exists between the lower end 36 of the drill pipe 30 and the upper end 22 of the drill pipe 20 is calculated. In the example shown in FIGS. 5 and 6, the measured length characteristics A, B, P and the stick-up height S are inputted into the controller 42 via either the link 46 or the user input device 44. The controller 42 then calculates, based upon the length characteristics A, B and the stick-up height S, the elevation distance D (FIG. 6) necessary to raise the drill pipe 30 above the rig floor 16 so that the lower end 36 of the drill pipe 30 and the upper end 22 of the drill pipe 20 are separated by a predetermined clearance distance C.

In this example, calculation of the elevation distance D is accomplished in two steps (managed in real time by the controller 42). First, the length B of tool joint 22 is subtracted from the total length A of pipe 30 to determine the free hanging length E. The free hanging length E is then added to the desired clearance distance C and to the stickup height S to obtain the distance D. In equation form, this logic presents as follows:

$$E=A-B$$

$$D=E+C+S$$

Figure 6:
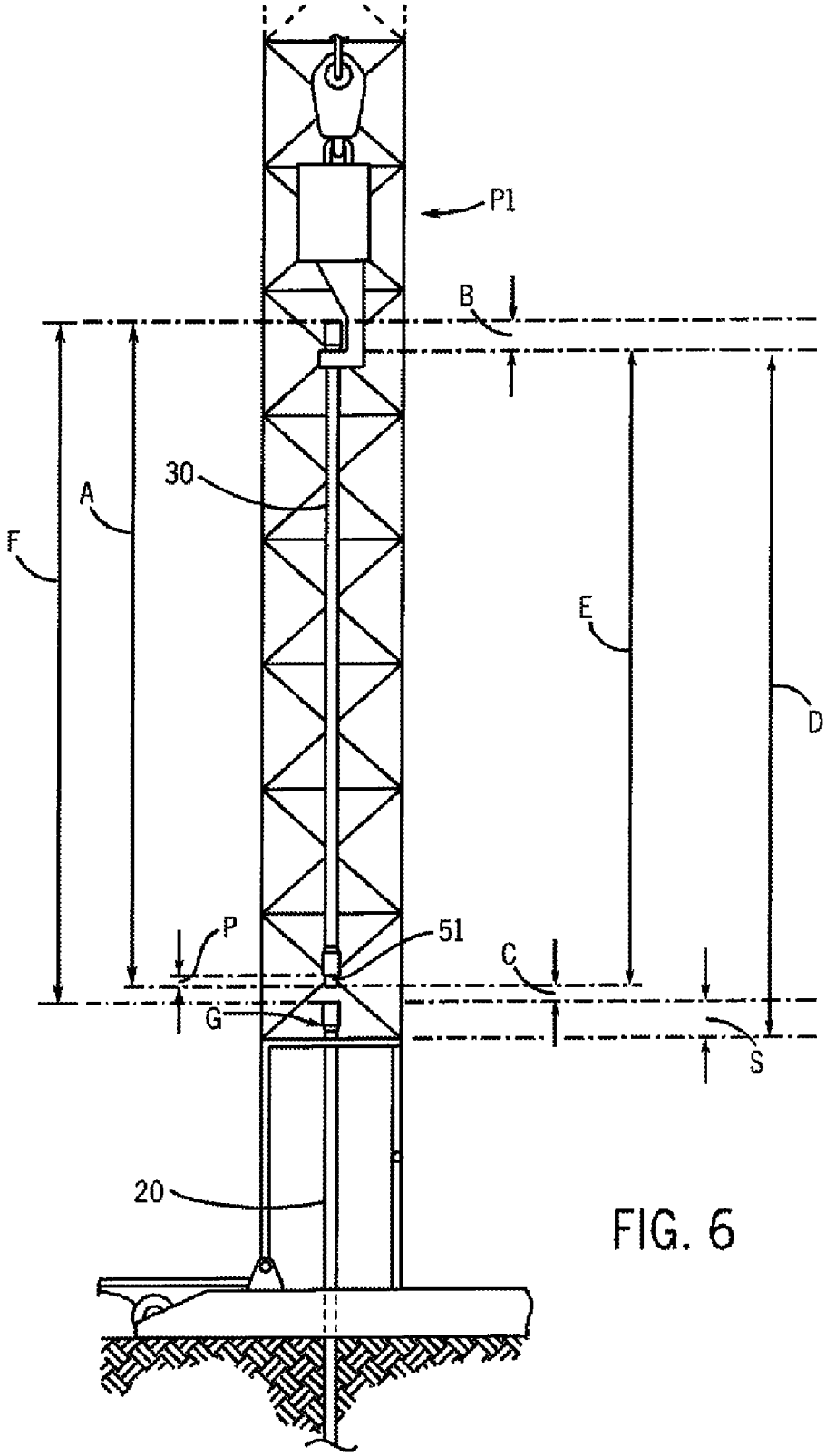
FIG. 6 is a detailed view of the drill rig shown in FIG. 5 showing a hoisting device in a raised position.

At Step 104 (FIG. 1), the drill pipe 30 is raised to the calculated elevation distance D to achieve the clearance distance C. In the example shown in FIGS. 4 and 5, the controller 42 communicates with the lifting mechanism 28 to actuate the lifting mechanism 28 and raise the drill pipe 30 to a position proximate the hoisting device 26. The controller 42 then actuates the hoisting device 26 to clamp the body 31 of the drill pipe 30 and to raise the hosting device 26 into a raised position, P1 (FIG. 6), and thus raise the upper end 34 of the drill pipe 30 the elevation distance D. Thus, as shown in FIG. 6, the drill pipe 30 is moved into the raised position P1 wherein the desired clearance distance C exists between the upper end 22 of the drill pipe 20 and the lower end 36 of the drill pipe 30.

At Step 106 (FIG. 1), the upper end 22 of the drill pipe 20 and the lower end 36 of the drill pipe 30 are connected. This step can be conducted by a conventional torque making machine, such as a mechanized wrench, tongs, and/or the like, positioned at the well center to engage and torque the upper end 22 of the drill pipe 20 and the lower end 36 of the drill pipe 30 together. In a preferred example, the controller 42 is configured to communicate with and control the torque making machine. Unlike conventional methods, operation of the torque making machine without manual intervention is possible because the controller 42 operates based upon the measurements A, B and the stick-up height S to ensure that the predetermined clearance distance C is achieved and to confirm that the stick-up height S is always constant and within operating parameters for the torque-making machine. This allows the torque-making machine to operate in one axis only, moving a fixed distance each time, allowing it to be part of the automated sequence managed by controller 42.

At Step 107 (FIG. 1), the position H (not shown in drawings) of the hoisting device 26 after connection of the drill pipes 20, 30 is calculated by the controller. In a preferred example, the controller 42 is configured to calculate this value by adding the stick-up height S to the free hanging length E and subtracting the measured pin length P for the particular pin 51 associated with the drill pipe 30. In equation form, this logic presents as follows:

$$H=S+E-P$$

At Step 108 (FIG. 1), the distance F necessary to move the drill pipe 30 downward into a lowered position P2 (FIG. 7) wherein a predetermined stick-up height S exists for the upper end 36 of drill pipe 30 is calculated. In the example shown in FIG. 7, the calculation of this distance is accomplished by subtracting the lowered position P2 of the hoisting device 26 from its raised position P1. The initial raised position P1 as noted in FIG. 6 for the hoisting device 26 or more specifically the clamp is P1=E+C+S while final lowered position P2 required for the clamp to maintain constant stick up S is P2=S−B. The distance F necessary to move the drill pipe 30 is hence the difference between these two positions given as:

$$F=E+C+S-(S-B)$$

$$F=E+C+B$$

$$F=A+C$$

Alternately, a position for the point of attachment of the traveling block associated with the hoisting device 26 to the body 31 of the drill pipe 30 can be determined. Thus the necessary position of the traveling block and a drill pipe 30 in the vertical direction can be determined. In this example, the stop point G can be calculated by subtracting the tool joint length B from the stick-up height S. In equation form, this logic presents as follows:

$$G=S-B$$

Figure 7:
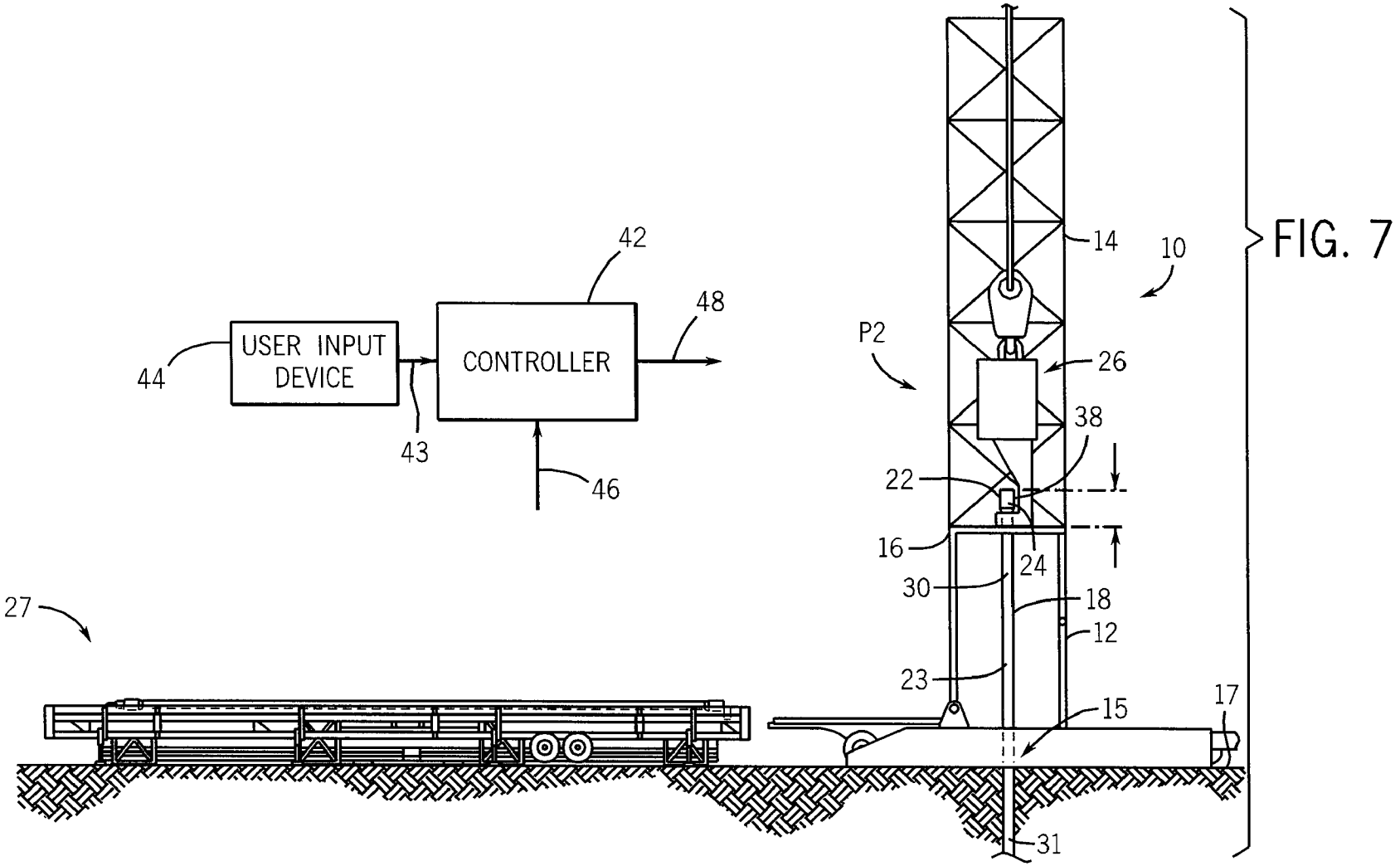
FIG. 7 is the schematic shown in FIG. 5 showing the hoisting device in a lowered position, wherein the drill pipe extends above a rig floor by a stick-up height.

At Step 110 (FIG. 1), the drill rig 10 is operated to move the drill pipe 30 the calculated distance F or to move the machinery to the position G. In the example, shown, the controller 42 communicates with and controls the slip mechanism (not shown) to release the drill string 18 and controls drilling machinery to move further into the hole 14. Once the hoisting device 26 reaches the reaches the stop point G (or once the drill pipe moves the drilling distance F), the controller 42 causes the movement to cease and the slip mechanism (not shown) to re-engage with and maintain the drill string 14 in a stationary position. As shown in FIG. 7, the drill pipe 30 is placed in a position so that it has the predetermined stick-up height S, allowing for the above-described process for tripping into the hole to repeat.

The following table provides exemplary output data for a method of tripping five drill pipes having different length characteristics.

| Stand | Measured Length of Drill Pipe "A" | Measured Length of Tool Joint "B" | Upset Length A − B = "E" | Clearance Desired Between Lower End of Drill Pipe and Upper End of Drill Pipe "C" | Stick-Up Height Desired for Upper End of Uppermost Drill Pipe in Drill String "S" | Elevation Distance Required to Attain Clearance "D" = (S + C + E) | Final Position of Lift Mechanism After Connection (Recorded by Controller) "H" = S + E − P "P" = Pin Length (P will vary from pipe to pipe - assuming 0.5' for this column for each pipe) | Stop Point Required to Attain Stick-Up Height for Drill Pipe "G" = S − B |
|---|---|---|---|---|---|---|---|---|
| 1 | 61.54 | 0.75 | 60.79 | .5 | 8 | 69.29 | 68.29 | 7.25 |
| 2 | 61.26 | 0.76 | 60.50 | .5 | 8 | 69.00 | 68.00 | 7.24 |
| 3 | 62.12 | 0.89 | 61.23 | .5 | 8 | 69.73 | 68.73 | 7.11 |
| 4 | 61.72 | 0.92 | 60.80 | .5 | 8 | 69.30 | 68.30 | 7.08 |
| 5 | 62.70 | 1.10 | 61.60 | | | | | |

The above described method steps also provide the ability to raise the drill string 18 out of the hole 15 so that the break out point or the upper end of each drill pipe in the string 18 is sequentially positioned at the predetermined stick-up height S, thus eliminating the need for manual control of the slip mechanism and the torque making machine. In the example shown, the controller 42 is configured to calculate a retrieval distance necessary for the uppermost drill pipe (here the drill pipe 30) to travel out of the well so that the upper end 34 of the drill pipe 30 is positioned so as to extend above the rig floor 16 by the predetermined stick-up height S. In effect the controller 42 uses the input during "trip in" to create a stack of length statistics for drill string components and uses the stack in "Last in First out" basis while "trip out" to move the hoisting device 26 to a pre-calculated height allowing to maintain constant stick of next drill pipe. In the example shown, the controller 42 utilizes the calculated position H of the lifting mechanism 26 to raise the drill string 18.

At Step 116 (FIG. 2), the upper end 22 of the drill pipe 20 and the lower end 36 of the drill pipe 30 can be disconnected. This step can be conducted by a conventional torque making machine, such as a mechanized wrench, tongs, and/or the like, positioned at the well center to engage and torque the upper end 22 of the drill pipe 20 and the lower end 36 of the drill pipe 30 together. As described above, the controller 42 can be configured to communicate with and control the torque making machine, thus eliminating the need for human intervention. The torque making machine will need to move in one axis only, allowing it to become part of the automation process.

The above described steps can be continued repeatedly to trip into the hole 15 or trip out of the hole 15.

What is claimed is:

1. A method of tripping pipe on a rig floor that is positioned over a well wherein a drill string extends out of the well, the drill string comprising a series of connected drill pipes, wherein an uppermost drill pipe in the series has an upper end that extends above the rig floor by a stick-up height, the method comprising the steps of:

measuring, with a measuring device operatively connected to and operatively controlled by a controller, a length characteristic of a first drill pipe that is separated from and out of alignment with the drill string;

receiving, at the controller, the length characteristic;

calculating, with the controller and based upon at least the length characteristic of the first drill pipe and the stick-up height, a first vertical position into which to position the first drill pipe upwardly and into vertical alignment with the drill string to achieve a predetermined clearance distance between the lower end of the first drill pipe and the upper end of the uppermost drill pipe in the drill string;

controlling machinery with the controller to position the first drill pipe upwardly above and into vertical alignment with the drill string to the first vertical position;

connecting the first drill pipe to the uppermost drill pipe in the drill string; and positioning the drill string into the well.

2. The method according to claim 1, comprising calculating a second vertical position of the first drill pipe that is associated with a connection of the first drill pipe and the uppermost drill pipe in the drill string.

3. The method according to claim 2, comprising lowering the first drill pipe into the second vertical position.

4. The method according to claim 3, comprising connecting the first drill pipe and the uppermost drill pipe in the drill string.

5. The method according to claim 4, comprising calculating, based upon at least the length characteristic of the first drill pipe and the stick-up height, a third vertical position at which the upper end of the first drill pipe extends above the rig floor by the stick-up height and lowering the drill string into the well until the upper end of the first drill pipe extends above the rig floor by the stick-up height.

6. The method according to claim 5, comprising storing the first, second and third vertical positions in the controller.

7. The method according to claim 6, comprising controlling the machinery with the controller to raise the drill string out of the well to the second vertical position and disconnecting the first drill pipe from the uppermost drill pipe in the drill string.

8. The method according to claim 5, measuring a second length characteristic of a second drill pipe; receiving, at the controller, the second length characteristic; controlling the machinery with the controller to position the second drill pipe upwardly above and into vertical alignment with the drill string to a fourth vertical position; connecting the second drill pipe to the upper end of the first drill pipe; positioning the drill string into the well; calculating, with the controller and based upon at least the length characteristic of the second drill pipe and the stick-up height, the fourth vertical position into which to position the second drill pipe upwardly and into vertical alignment with the drill string to achieve the predetermined clearance distance between the lower end of the second drill pipe and the upper end of the first drill pipe.

9. The method according to claim 8, comprising calculating a fifth vertical position of the second drill pipe that is associated with a connection of the second drill pipe and the first drill pipe; and lowering the second drill pipe into the fifth vertical position.

10. The method according to claim 9, comprising connecting the second drill pipe and the first drill pipe.

11. The method according to claim 10, comprising calculating, based upon at least the second length characteristic of the second drill pipe and the stick-up height, a sixth vertical position at which the upper end of the second drill pipe extends above the rig floor by the stick-up height lowering the drill string into the well until the upper end of the second drill pipe extends above the rig floor by the stick-up height.

12. The method according to claim 1, comprising measuring a plurality of different length characteristics of the first drill pipe and calculating, based upon at least the plurality of different length characteristics and the stick-up height, the first vertical position in which the predetermined clearance distance exists between the first drill pipe and the upper end of the uppermost drill pipe in the drill string.

13. The method according to claim 12, wherein the upper end of the first drill pipe comprises a tube joint and wherein the plurality of different length characteristics of the first drill pipe comprises the length of the first drill pipe and the length of the tube joint.

14. The method according to claim 13, wherein the lower end of the first drill pipe comprises a pin and wherein the plurality of different length characteristics of the first drill pipe comprises the length of the pin.

15. The method according to claim 1, wherein the measuring device is configured on the lifting mechanism.

16. The method according to claim 15, wherein the operating of the measuring device takes place on the lifting mechanism.

17. The method according to claim 16, comprising positioning the first drill pipe on a catwalk in turn configured on the lifting mechanism such that the first drill pipe is in a substantially horizontal position.

18. The method according to claim 17, comprising using a skate to push the first drill pipe against a stopper located on the catwalk, wherein the measuring device determines the distance between the skate and stopper to determine the length characteristic of the first drill pipe.

19. The method according to claim 18, comprising lifting the first drill pipe to a position proximate the hoisting device.

20. The method according to claim 19, comprising positioning the first drill pipe from the horizontal position into the first vertical position.

21. A system for tripping pipe on a rig floor that is positioned over a well, wherein a drill string extends out of the well, the drill string comprising a series of connected drill pipes, wherein an uppermost drill pipe in the series has an upper end that extends above the rig floor by a stick-up height, the system comprising:

a measuring device;

a controller operatively connected to the measuring device and configured to control the measuring device to measure a length characteristic of a first drill pipe that is separated from and out of alignment with the drill string;

wherein the controller is further configured to receive the measured length characteristic and calculate, based upon the length characteristic and the stick-up height, a first vertical position into which to position the first drill pipe upwardly and into vertical alignment with the drill string to achieve a predetermined clearance distance between the lower end of the first drill pipe and the upper end of the uppermost drill pipe in the drill string; and wherein the controller is further configured to control machinery to position the first drill pipe at the first vertical position.

22. The system according to claim 21, wherein the measuring device is configured to measure a plurality of different length characteristics of the first drill pipe and wherein the controller is configured to receive the plurality of different length characteristics of the first drill pipe and calculate, based upon at least the plurality of different length characteristics and the stick-up height, the first vertical position.

23. The system according to claim 22, wherein the upper end of the first drill pipe comprises a tube joint, and wherein the plurality of different length characteristics comprises a length of the drill pipe from the upper end to the lower end and a length of the tube joint.

24. The system according to claim 22, wherein the lower end of the first drill pipe comprises a pin and the plurality of different length characteristics further comprises a length of the pin.

25. The system according to claim 21, comprising a catwalk for positioning the first drill pipe.

26. The system according to claim 25, wherein the measuring device comprises a feeler gauge configured to engage with outer surfaces of the first drill pipe to facilitate measurement of the length characteristic.

27. A system for tripping pipe on a rig floor that is positioned over a well, wherein a drill string extends out of the well, the drill string comprising a series of connected drill pipes, wherein an uppermost drill pipe in the series has an upper end that extends above the rig floor by a stick-up height, the system comprising:

a measuring device configured to measure a length characteristic of a first drill pipe in a plurality of separated drill pipes;

a controller configured to receive the measured length characteristic and calculate based upon the length characteristic and the stick-up height a first vertical position into which it is necessary to move the first drill pipe upwardly and into vertical alignment with the drill string so that a predetermined clearance distance exists between the lower end of the first drill pipe and the upper end of the uppermost drill pipe in the drill string;

wherein the controller is further configured to control machinery to hoist the first drill pipe into the first vertical position; and a catwalk for positioning the first drill pipe;

wherein the measuring device comprises a feeler gauge configured to engage with outer surfaces of the first drill pipe to facilitate measurement of the length characteristic; and a skate and a stopper on the catwalk, the skate configured to push the first drill pipe towards the stopper, wherein the measuring device determines the distance between the skate and stopper to determine the length characteristic of the first drill pipe.

28. The system according to claim 27, wherein the measuring device is configured to measure a plurality of different length characteristics of the first drill pipe and wherein the controller is configured to receive the plurality of different length characteristics of the first drill pipe and calculate, based upon at least the plurality of different length characteristics and the stick-up height, the first vertical position.

29. The system according to claim 28, wherein the skate is configured to push the first drill pipe towards the feeler gauge so that the feeler gauge measures the length of a tube joint on the upper end of the first drill pipe, wherein the length of the tube joint on the upper end of the first drill pipe comprises one of the plurality of different length characteristics of the first drill pipe.

* * * * *